US008280553B2

(12) United States Patent
Oh et al.

(10) Patent No.: US 8,280,553 B2
(45) Date of Patent: Oct. 2, 2012

(54) LIP MOVING DEVICE FOR USE IN ROBOTS

(75) Inventors: Kyung Goune Oh, Seoul (KR); Seung-Jong Kim, Seoul (KR); Myoung Soo Jang, Seoul (KR); Chan Yul Jung, Bucheon-si (KR)

(73) Assignee: Korea Institute of Science and Technology, Seoul (KR)

( * ) Notice: Subject to any disclaimer, the term of this patent is extended or adjusted under 35 U.S.C. 154(b) by 350 days.

(21) Appl. No.: 12/765,113

(22) Filed: Apr. 22, 2010

(65) Prior Publication Data

US 2010/0286828 A1 Nov. 11, 2010

(30) Foreign Application Priority Data

May 11, 2009 (KR) ..... 10-2009-0040577

(51) Int. Cl.
*G05B 15/00* (2006.01)

(52) U.S. Cl. ..... 700/261; 700/245; 700/247; 700/250; 700/260; 446/301; 446/329; 446/395

(58) Field of Classification Search ..... 700/245, 700/247, 250, 260, 261; 446/300, 301, 304, 446/329, 330, 337, 395
See application file for complete search history.

(56) References Cited

U.S. PATENT DOCUMENTS

| | | | | |
|---|---|---|---|---|
| 6,068,536 | A * | 5/2000 | Madland et al. | 446/337 |
| 6,238,262 | B1 * | 5/2001 | Pracas | 446/301 |
| 7,322,874 | B2 * | 1/2008 | Ellman et al. | 446/345 |
| 7,740,953 | B2 * | 6/2010 | Jackson et al. | 428/542.8 |
| 7,853,876 | B2 * | 12/2010 | Hung et al. | 715/706 |
| 2007/0128979 | A1 * | 6/2007 | Shackelford et al. | 446/484 |
| 2010/0144239 | A1 * | 6/2010 | Eck et al. | 446/330 |
| 2010/0161122 | A1 * | 6/2010 | Lin | 700/245 |
| 2011/0087354 | A1 * | 4/2011 | Tye et al. | 700/98 |

FOREIGN PATENT DOCUMENTS

| | | | |
|---|---|---|---|
| JP | 2002-178278 | A | 6/2002 |
| KR | 10-0806126 | B1 | 2/2008 |
| WO | WO 03/099406 | A1 | 12/2003 |

OTHER PUBLICATIONS

Breazeal, C.L. (May 2000) "Sociable Machines: Expressive Social Exchange Between Humans and Robots", at least pp. 56-58, 176-194 and 219-226.*

Kim, D.H., An K.H., Ryu, Y.G., Chung M.J. (Sep. 2007). "A Facial Expression Imitation System for the Primitive of Intuitive Human-Robot Interaction" Human-Robot Interaction, pp. 213-234.*

* cited by examiner

*Primary Examiner* — Khoi Tran
*Assistant Examiner* — Jonathan L Sample
(74) *Attorney, Agent, or Firm* — NSIP Law

(57) ABSTRACT

Various embodiments of a lip moving device for use in robots are provided. A lip moving device has first and second lip members. The first and second lip members are made from a flexible material. First and second driving parts apply torques to both ends of the first lip member, while third and fourth driving parts apply torques to both ends of the second lip member. The first and third driving parts are mounted in a first frame. The second and fourth driving parts are mounted in a second frame. The first and second frames are pivotally coupled to a supporting part. An adjusting part pivots the first and second frames relative to the supporting part to adjust a distance between the first and second frames.

7 Claims, 9 Drawing Sheets

LIP MOVING DEVICE FOR USE IN ROBOTS

CROSS-REFERENCE TO RELATED APPLICATIONS

This application claims priority to Korean Patent Application No. 10-2009-40577 filed on May 11, 2009, the entire disclosure of which is incorporated herein by reference.

BACKGROUND

Robots can generally be described as being machines that have a shape similar to a human, act like a human, or have a self-working capability. Robots that have the capability of perceiving an environment and recognizing the situation resulting from such an environment are referred to as intelligent robots. Robots that have a shape similar to that of human or have movements that resemble a human, are referred to androids or humanoids.

Research and development on robots have been made in various fields for toys, pets, services, security, extremely dangerous environmental work, advertisement, etc. Such research and development focus upon more complicated mechanisms, e.g., artificial intelligence, and shows various facial expressions in addition to biped working function, to create robots that more closely resemble a human.

Robots for toys, pets, advertisement, etc, in particular an android or humanoid, needs to show diverse emotional facial expressions. Such facial expressions can be performed by changing positions of eyebrows, eyeballs or changing the shape of lips. Further, lip-synching can be performed by appropriately changing the shape of lips.

With regard to technologies for changing lip-shapes to show change in facial expressions and perform lip-synching change of the facial expressions, existing technologies use an indirect lip moving method, wherein driving forces are applied to a predetermined point of an artificial skin or muscle adjacent to the lip member, and a direct lip moving method, wherein lips are directly moved.

With Reference to FIGS. 1 to 2, a prior art method for moving robot lips and a prior art lip moving device are described.

FIG. 1 illustrates various facial expressions that can be shown by a prior art robot. FIG. 2 illustrates various example movements of lips shown in FIG. 1. FIG. 1 illustrates facial expressions, which a robot 'Icat' manufactured by Philips Co., Ltd. can show. It can show five facial expressions such as expressionlessness, curiousness, smile, anger and laugh by changing positions of lips 10, an eyeball 20 and an eyebrow 30. Torque is applied to ends of an upper lip 10*a* or a lower lip 10*b* to change the position of the lips 10.

The prior art lip moving device can rotate both ends of the upper lip 10*a* and the lower lip 10*b* respectively. As shown in FIG. 2, the prior art lip moving device has a first motor 11*a* fixed to one end of the upper lip 10*a*, a second motor 12*a* fixed to the other end of the upper lip 10*a*, a third motor 11*b* fixed to one end of the lower lip 10*b* and a fourth motor 12*b* fixed to the other end of the lower lip member 10*b*.

To show a facial expression such as expressionlessness with lips closed, as shown in FIG. 2(*a*), the first to fourth motors 11*a*, 12*a*, 11*b*, 12*b* do not operate and the upper lip 10*a* and the lower lip 10*b* are maintained in a horizontal state.

To show a facial expression such as curiousness, 10*b* as shown in FIG. 2(*b*), the first to fourth motors 11*a*, 12*a*, 11*b*, and 12*b* counterclockwise rotate such that the upper lip 10*a* and the lower lip 10*b* form a waved shape as the upper lip 10*a* contacts the lower lip.

To show a facial expression such as smile, as shown in FIG. 2(*c*), the first and third motors 11*a*, 11*b* clockwise rotate and the second and fourth motors 12*a*, 12*b* counterclockwise rotate, thereby downwardly curving the upper and lower lips 10*a*, 10*b* as the upper lip 10*a* contacts the lower lip 10*b*.

To show a facial expression such as anger, as shown in FIG. 2(*d*), the first and third motors 11*a*, 11*b* counterclockwise rotate and the second and fourth motors 12*a*, 12*b* clockwise rotate, thereby upwardly curving the upper and lower lips 10*a*, 10*b* as the upper lip 10*a* contacts the lower lip 10*b*.

To show a facial expression such as a laugh, as shown in FIG. 2(*e*), the first and fourth motors 11*a*, 12*b* counterclockwise rotate and the second and third motors 12*a*, 11*b* clockwise rotate, thereby upwardly curving the upper lip 10*a* and downwardly curving the lower lip 10*b*, as a middle section of the upper lip 10*a* is separated from a middle section of the lower lip 10*b*.

However, the facial expressions, which the prior art lip moving device can express, are limited as explained above. Thus, the prior art lip moving device fails to show various facial expressions and to perform lip-sync through delicate lip shape change.

SUMMARY

Various embodiments of a lip moving device for use in robots are provided. In one embodiment of the present disclosure, by way of non-limiting example, a lip moving device for use in robots includes first and second lip members, first to fourth driving parts, a frame member and a control part. The first and second lip members are made from a flexible material. The first driving part applies a torque to one end of the first lip member. The second driving part applies a torque to the other end of the first lip member. The third driving part applies a torque to one end of the second lip member. The fourth driving part applies a torque to the other end of the second lip member. The frame member includes first and second frames and a supporting part. The first frame mounts the first and third driving parts therein. The second frame mounts the second and fourth driving parts therein. The first and second frames are pivotally coupled to the supporting part. The adjusting part is configured to pivot the first frame and the second frame relative to the supporting part to adjust a distance between the first and third driving parts and the second and fourth driving parts and a width between the both ends of the first and second lip members. The control part is configured to control the torques of the first to fourth driving parts and to drive the adjusting part.

In one embodiment, each of the driving parts includes a motor shaft, a coupling shaft being apart from the motor shaft and an arm connecting the motor shaft and the coupling shaft. The coupling shafts are coupled to ends of the first and second lip members.

In one embodiment, the adjusting part includes a cam motor, a cam having a cam profile, first and second cam pins. The cam motor is mounted on the supporting part. The cam is rotatably coupled to the cam motor. The first cam pin is disposed on the first frame. The first cam pin contacts the cam profile to pivot the first frame relative to the supporting part when the cam rotates. The second cam pin is disposed on the second frame. The second cam pin contacts the cam profile to pivot the second frame relative to the supporting part when the cam rotates. The cam profile includes symmetrical first and second cam slots.

The Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Arrangements and embodiments may be described in detail with reference to the following drawings in which like reference numerals refer to like elements and wherein.

DETAILED DESCRIPTION

A detailed description may be provided with reference to the accompanying drawings. One of ordinary skill in the art may realize that the following description is illustrative only and is not in any way limiting. Other illustrative embodiments may readily suggest themselves to such skilled persons having the benefit of this disclosure.

Figure 1:
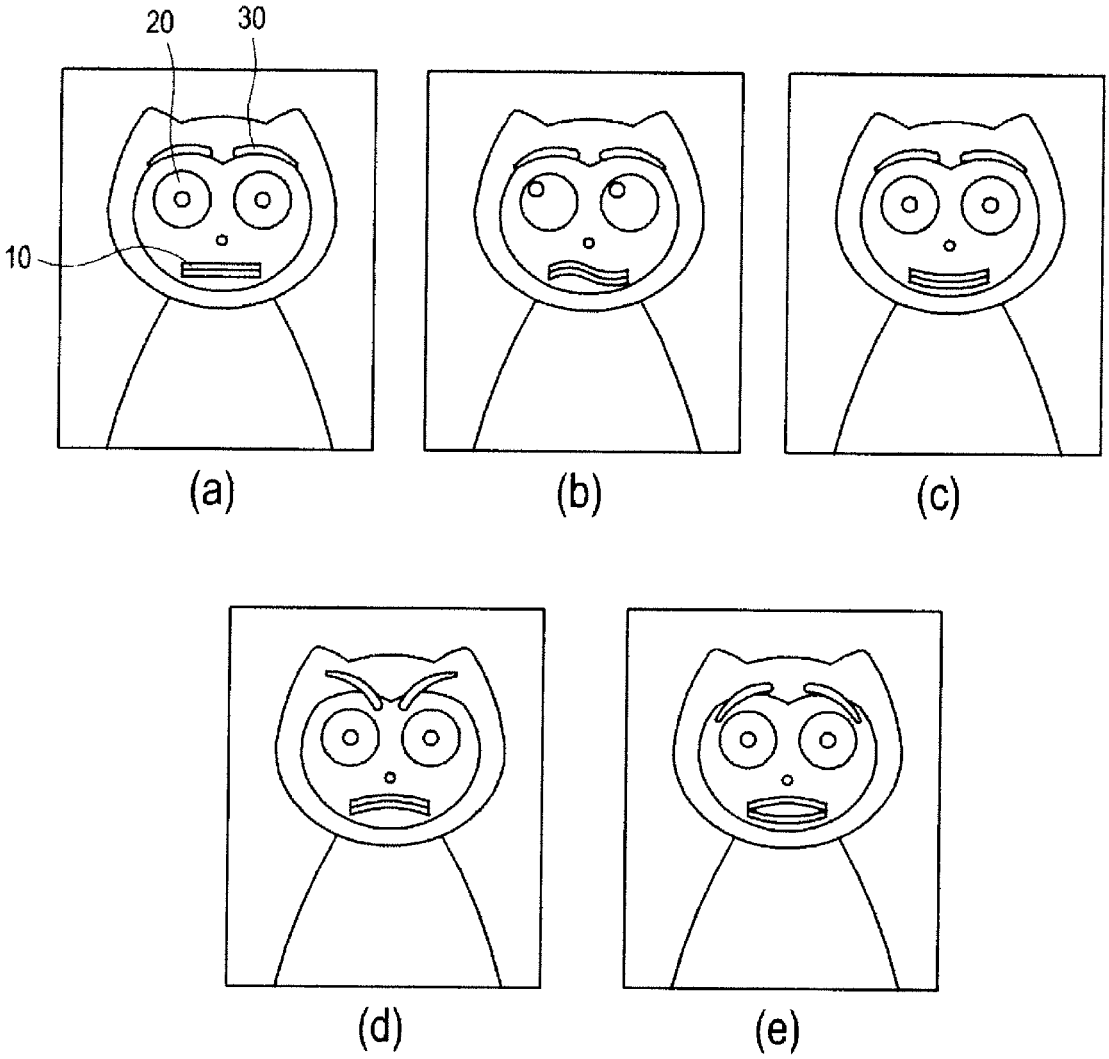
FIG. 1 (PRIOR ART)
FIG. 1 illustrates various facial expressions that can be shown by a prior art robot.
Figure 2:
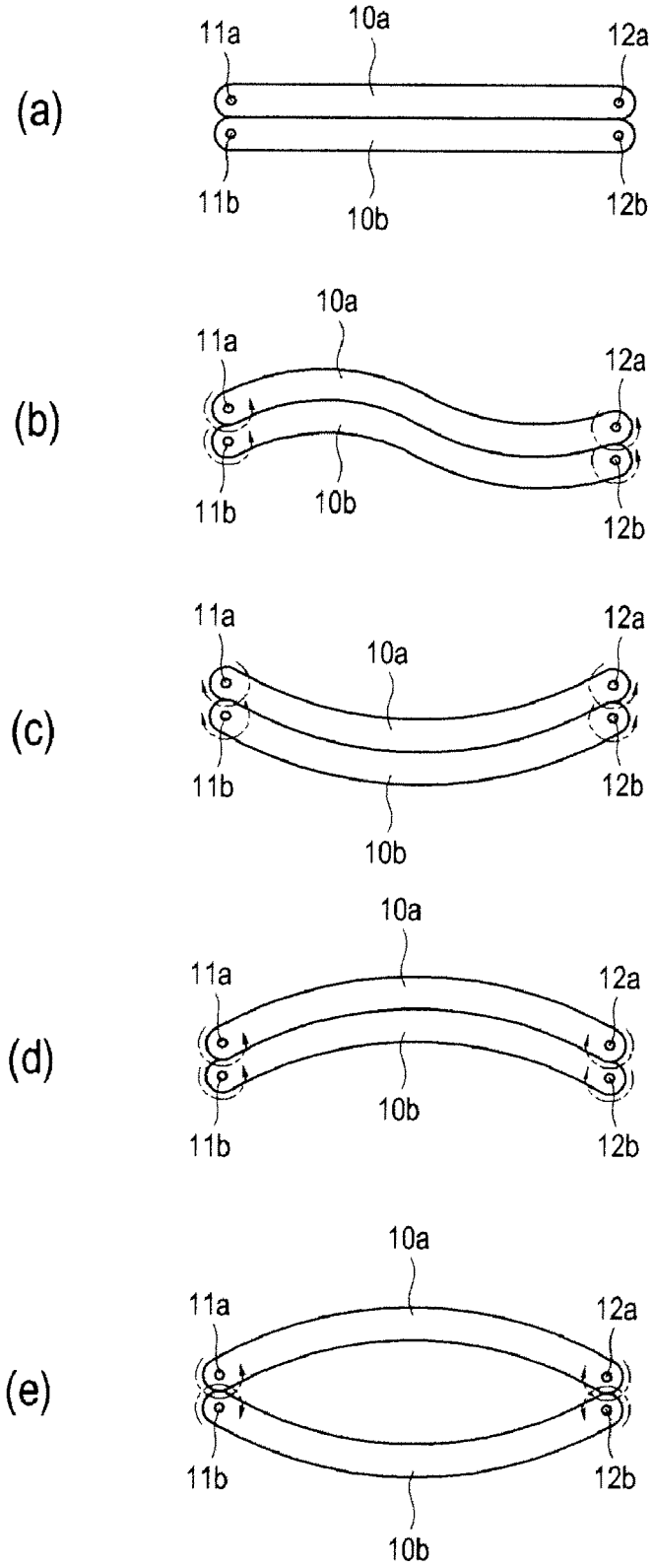
FIG. 2 (PRIOR ART)
FIG. 2 illustrates various example movements of lips shown in FIG. 1.
Figure 3:
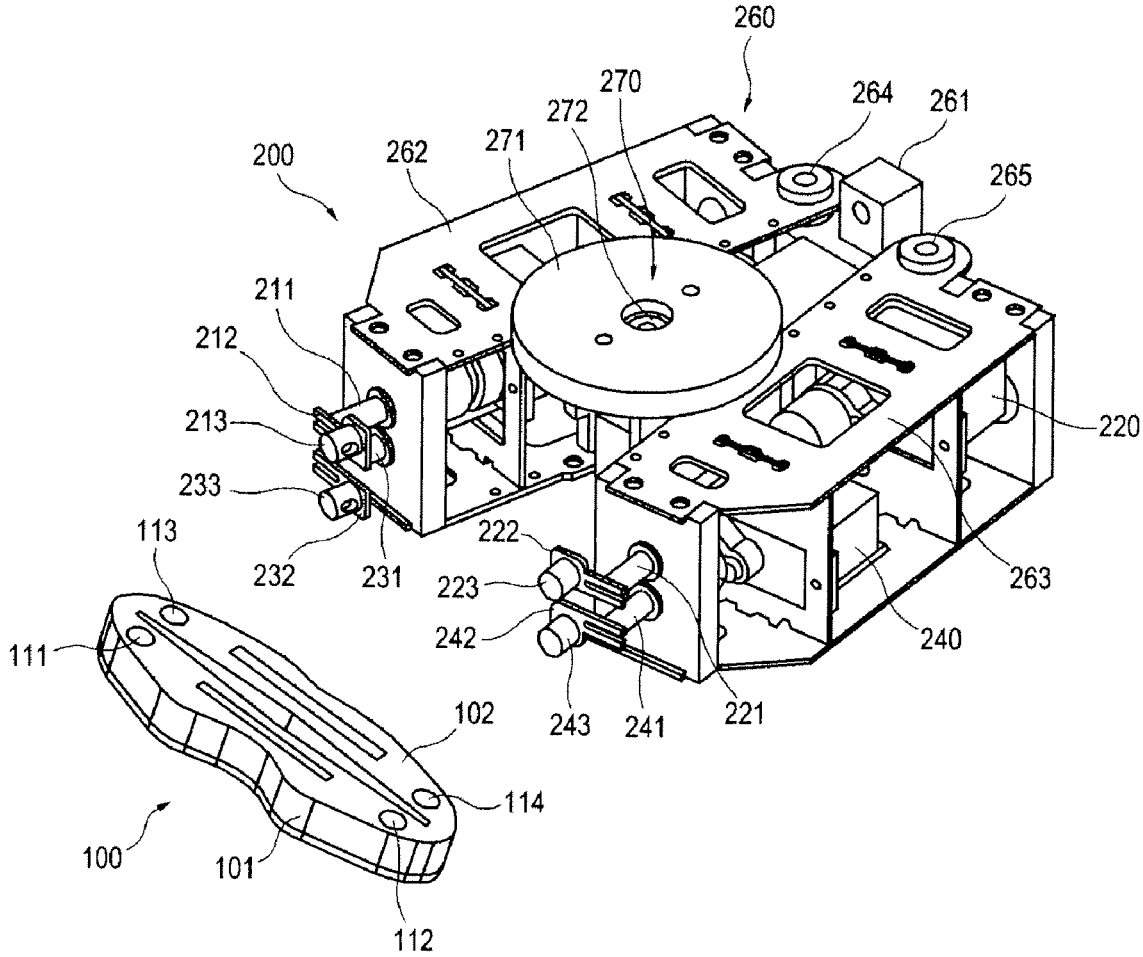
FIG. 3 is a perspective view illustrating a lip moving device for use in robots according to one embodiment of the disclosure.
Figure 4:
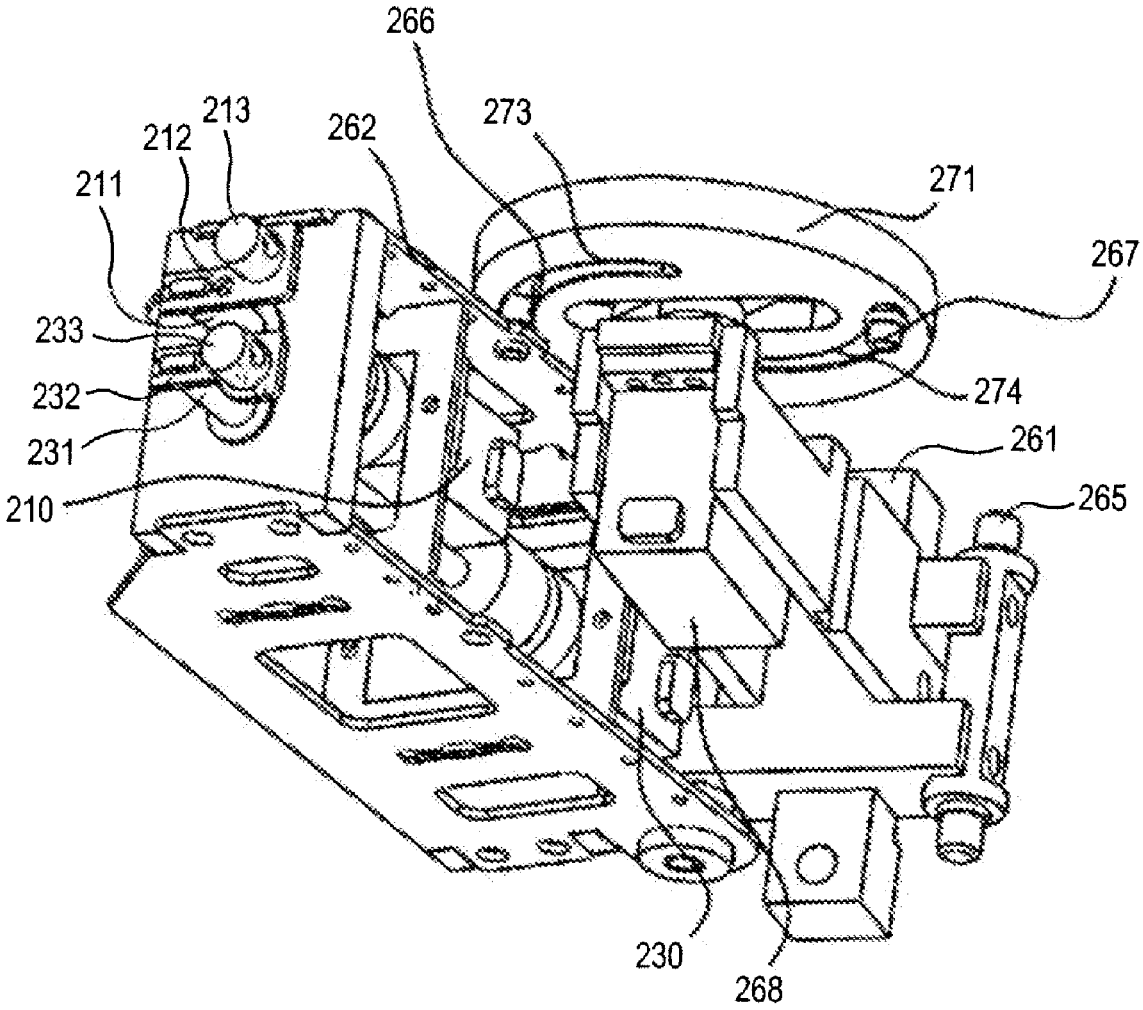
FIG. 4 is a perspective view illustrating a first frame, a supporting part and a cam shown in FIG. 3.
Figure 5:
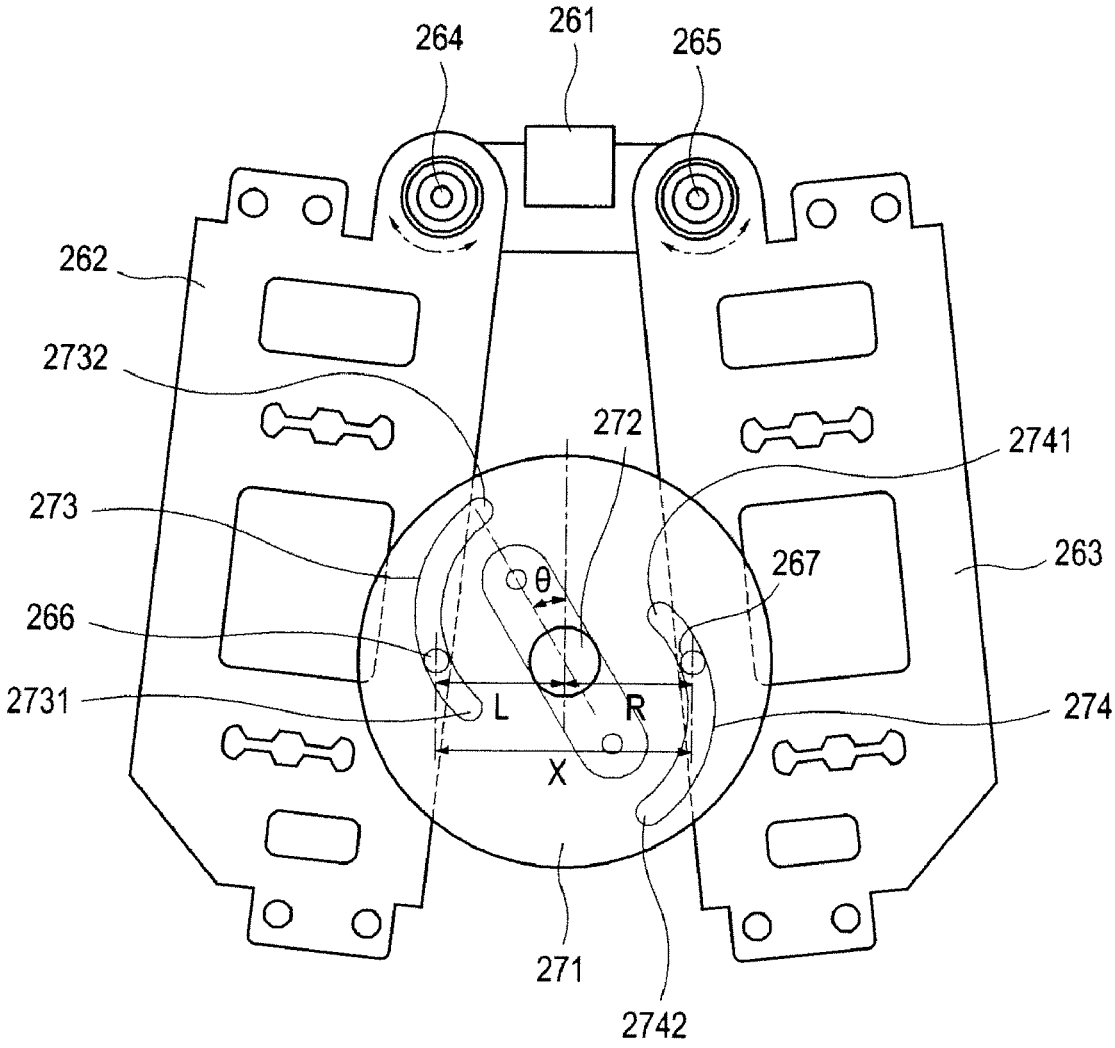
FIG. 5 is a partial plan view illustrating the lip moving device shown in FIG. 3.

FIG. 3 illustrates a lip moving device for use in robots in accordance with one embodiment of the present disclosure. FIG. 4 illustrates a first frame and a supporting part shown in FIG. 3. FIG. 5 a partial plan view of the lip moving device shown in FIG. 3.

Referring to FIG. 3, the lip moving device moves or drives a first lip member 101 and a second lip member 102. The first and second lip members 101, 102 may comprise a flexible or resilient material. The second lip member 102 may be juxtaposed relative to the first lip member 101. The second lip member 102 may be parallel to the first lip member 101. Each of the first and second lip members 101, 102 has one end and the other end in its length direction. In this embodiment, one end of the first lip member 101 is joined to one end of the second lip member 102, while the other end of the first lip member 101 is joined to the other end of the second lip member 102. Thus, the first and second lip members 101, 102 form an integrated lip member 100. A shape of the lip member 100 may be changed when the first lip member 101 and the second lip member 102 are moved or driven by the lip moving device.

The first lip member 101 is an upper part of the integrated lip member 100. A first shaft hole 111 is formed in the one end of the first lip member 101 and a second shaft hole 112 is formed in the other end of the first lip member 101. The second lip member 102 is a lower part of the integrated lip member 100. A third shaft hole 113 is formed in the one end of the second lip member 102 below the first shaft hole 111 and a fourth shaft hole 114 is formed in the other end of the second lip member 102 below the second shaft hole 111.

A lip driving part 200 is configured to drive or move the lip member 100. The lip driving part 200 includes the following: a first motor 210 configured to apply a torque to the first shaft hole 111 of the lip member 100; a second motor 220 configured to apply a torque to the second shaft hole 112 of the lip member 100; a third motor 230 configured to apply to a torque to the third shaft hole 113 of the lip member 100; and a fourth motor 240 configured to apply a torque to the fourth shaft hole 114 of the lip member 100.

A first motor shaft 211 of the first motor 210 is coupled to a first coupling shaft 213 through a first arm 212. A second motor shaft 221 of the second motor 220 is coupled to a second coupling shaft 223 through a second arm 222. A third motor shaft 231 of the third motor 230 is coupled to a third coupling shaft 233 through a third arm 232. A fourth motor shaft 241 of the fourth motor 240 is coupled to a fourth coupling shaft 243 through a fourth arm 242. The first to fourth coupling shafts 213, 223, 233, 243 are fixedly fitted or inserted to the respective first to fourth shaft holes 111, 112, 113, 114.

The arms 212, 222, 232, 242 are moment arms. Each of the arms makes each of the motor shafts 211, 221, 231, 241 be apart from the each of the coupling shafts 213, 223, 233, 243, thereby increasing a rotational displacement of each coupling shaft coupled to the first or second lip member 101, 102, when each motor operates, and further thereby extending deformation or shape change of the lip member 100. Particularly, such a spaced-apart arrangement between the motor shafts and the coupling shafts allows the lip member 100 to deform by a bending force rather than a torsional force, thereby providing effective deformation of the lip member 100.

The first and the second motor shafts 211, 221 are positioned at the both ends of the first lip member 101, respectively. The first and the second coupling shafts 213 and 223 are positioned apart from the first and second motor shafts 211, 221 respectively. The third and fourth motor shafts 231, 241 are positioned at the both ends of the second lip member 102 respectively. The third and fourth coupling shafts 233, 243 are positioned apart from the third and fourth motor shafts 231, 241 respectively. Thus, when motor operates, each of the coupling shafts rotates or pivots about respective motor shafts while forming a circle having a radius corresponding to a distance between the motor shaft and the coupling shaft, thereby deforming the lip member 100. In the illustrated embodiment, each of the coupling shafts is inwardly apart from its corresponding motor shaft. Other embodiments may include coupling shafts that are outwardly apart from its corresponding motor shafts.

The first to fourth motors 210, 220, 230, 240 are mounted in a frame member 260. The frame member 260 includes a supporting part 261, a first frame 262 and a second frame 263. The first and third motors 210, 230 are mounted in the first frame 262, while the second and fourth motors 220, 240 are mounted in the second frame 263.

The first and second frames 262, 263 are pivotally coupled to the supporting part 261 that is located therebetween. The supporting part 261 is fixed or fitted to a main body of a robot (not shown). In this embodiment, the first frame 262 is pivotally coupled to a rear left portion of the supporting part 261 through a first pivot shaft 264, while the second frame 263 is pivotally coupled to a rear right portion of the supporting part 261 through a second pivot shaft 265. Other embodiments may include first and second frames hinge-jointed to a supporting part through a single pivot shaft.

Each of the coupling shafts 213, 223, 233, 243 associated with each of the motors is projected forward from the first and the second frame 262, 263. Thus, when the first frame 262 and the second frame 263 pivot about the first pivot shaft 264 and the second pivot shaft 265 respectively to thereby increase a distance therebetween, a distance between the first/third coupling shafts 213, 233 and the second/fourth coupling shafts 223, 243 becomes greater. Thus, a distance between the both ends of the lip member 100 becomes greater accordingly. On the other hand, when the first frame 262 and the second frame 263 pivot about the first pivot shaft 264 and the second pivot shaft 265 respectively to thereby decrease the distance therebetween, the distance between the first/third coupling shafts 213, 233 and the second/third coupling shafts 223, 243 becomes smaller. Thus, the distance between the both ends of the lip member 100 becomes smaller accordingly.

A cam motor 268 is mounted to the supporting part 261. A cam 270 is rotatably coupled to the cam motor 268. The cam 270 includes a cam body 271, a cam shaft and a cam profile. The cam body 271 has a circular disk shape. The cam shaft 272 is configured to couple a center of the cam body 271 to a drive shaft of the cam motor 268. The cam profile includes a first cam slot or cam groove 273 and a second cam slot or cam groove 274. The first and second cam slots 273, 274 have a curved shape a shape concave toward the cam shaft 272. In one embodiment, the first and second cam slots 273, 274 have a circular arc shape. The first and second cam slots 273, 274 may be arranged on the cam body 271 in a spirally outward extension shape. Specifically, the first and second cam slots 273, 274 are arranged on the cam body 271 such that any points in the first cam slot 273 are point-symmetric to any points in the second cam slot 274 about the cam shaft 272. As shown in FIGS. 4 and 5, a distance between a first end 2731 of the first cam slot 273 and a first end 2741 of the second cam slot 274 that is point-symmetric to the first end 2731 is shortest. Further, a distance between a second end 2732 of the first cam slot 273 and a second end 2742 of the second cam slot 274 that is point-symmetric to the second end 2732 is longest. Further, point-symmetrical distances between the corresponding point-symmetric points in the first and the second cam slots 273, 274 become greater from the first ends 2731, 2741 toward the second ends 2732, 2742.

A first cam pin 266 is slidably fitted or inserted to the first cam slot 273 and a second cam pin 267 is slidably fitted or inserted to the second cam slot 273. The first cam pin is disposed on and fixedly or rotatably coupled to the first frame 262 while the second cam pin 267 is disposed on and fixedly or rotatably coupled to the second frame 263. A distance between the first cam pin 266 and the cam shaft 272 is equal to a distance between the second cam pin 267 and the cam shaft 272. That is, the first and second cam pins 266, 272 may be equi-spaced from the cam shaft 272. Thus, when the cam motor 268 operates, the first cam slot 273 allows the first cam pin 266 to move outwardly or inwardly and the second cam slot 274 allows the second cam pin 267 to move outwardly or inwardly, thereby varying the distance between the first cam pin 266 and the second cam pin 267. Thus, with action caused by the cam slots and the cam pins, the first frame 262 pivots about the first pivot shaft 264 relative to the supporting part 261 and the second frame 263 pivots about the second pivot shaft 265 relative to the supporting part 26, thereby widening or narrowing the distance or width between the first frame 262 and the second frame 263.

Figure 6:
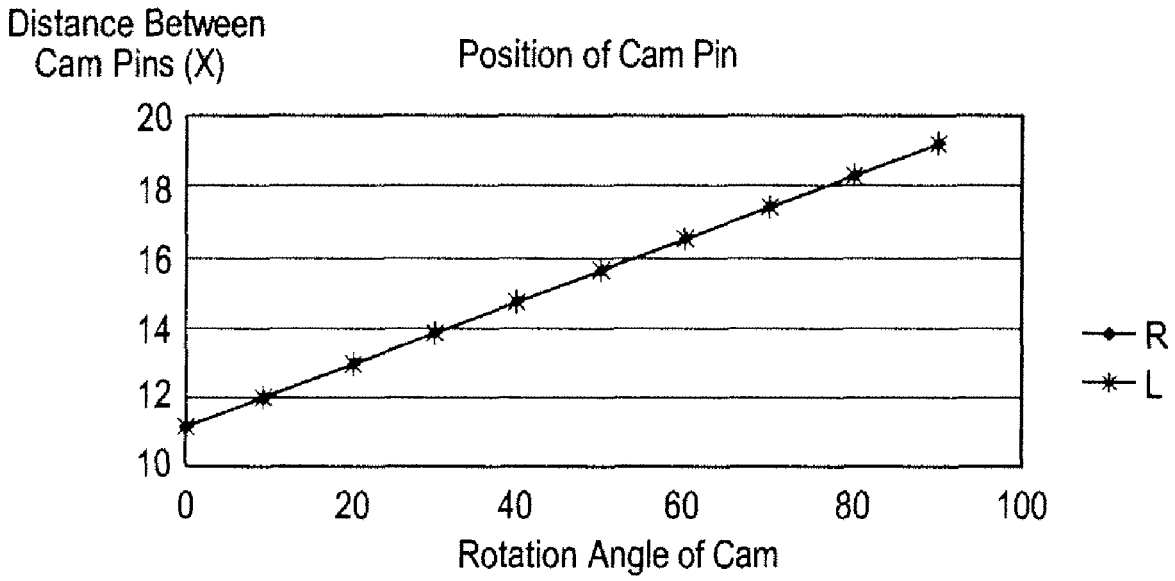
FIG. 6 is a graph showing a change in a distance between first and second cam pins according to rotation of a cam.

FIG. 6 is a graph showing a change of the distance between the first and second cam pins according to the rotation of the cam. Initially, the first cam pin 266 is positioned at the first end 2731 of the first cam slot 273, while the second cam pin 267 is positioned at the first end 2741 of the second cam slot 274 that is point-symmetric to the first end 2731 of the first cam slot 273.

As the cam 270 counterclockwise rotates about the cam shaft 272 as shown in FIG. 5, the distance X between the first and second cam pins 266, 267 varies according to a rotation angle θ of the cam 270 as shown in FIG. 6. Thus, controlling the cam motor 268 may adjust the distance between the first frame 262 and the second frame 263.

Figure 7:
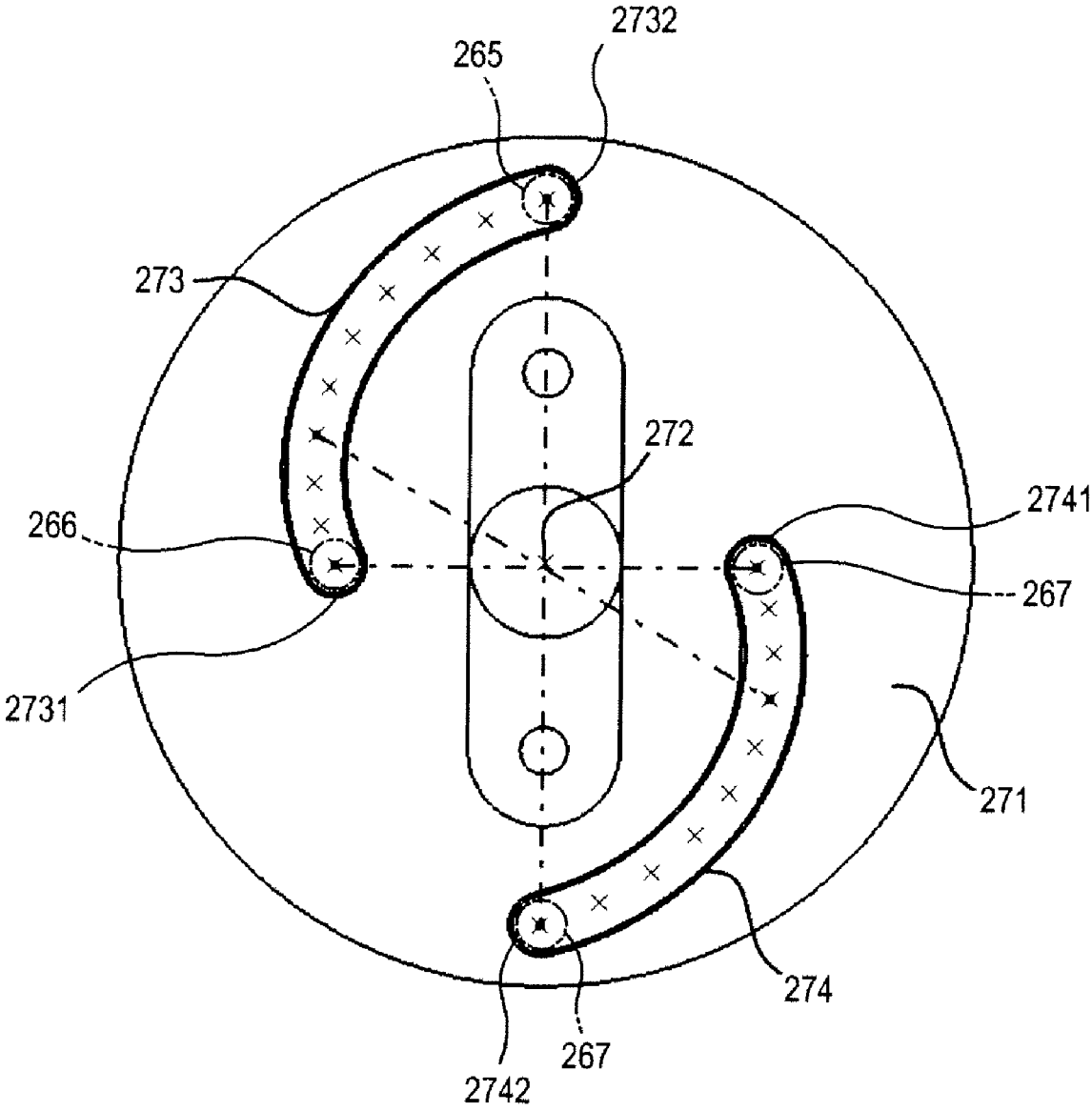
FIG. 7 is a plan view of the cam illustrating relative positions between the first and second cam pins and the cam.

FIG. 7 illustrates relative positions between the first and second cam pins and the cam. As shown in FIG. 7, the first cam pin 266 moves within the first cam slot 273 from its first end 2731 to its second end 2732, while the second cam pin 267 moves within the second cam slot 274 from its first end 2741 to its second end 2742. The distance between the first cam pin 266 at the first end 2731 of the first cam slot 273, and the second cam pin 267 at the first end 2741 of the second cam slot 274 symmetrically corresponding thereto, is shorter than the distance between the first cam pin 266 at the second end 2732 of the first cam slot 273, and the second first cam pin 267 at the second end 2742 of the second cam slot 274 symmetrically corresponding thereto.

Figure 8:
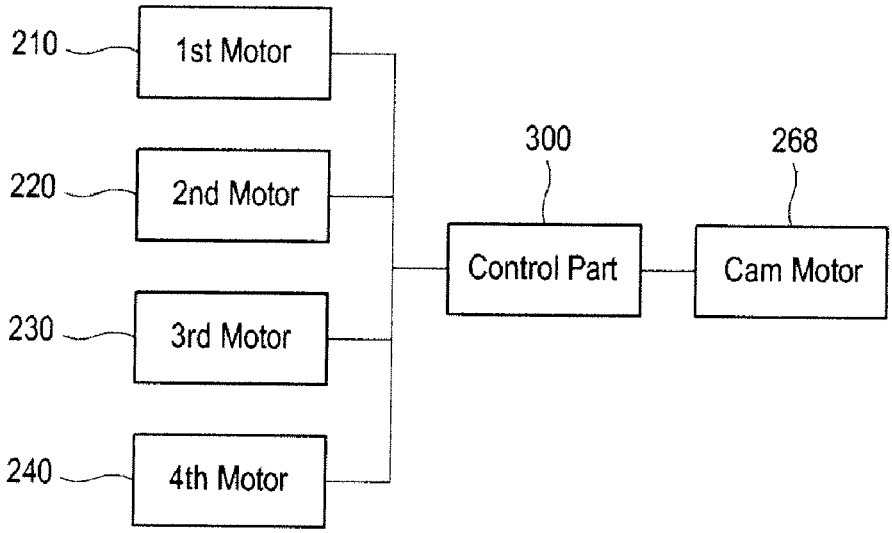
FIG. 8 is a block diagram schematically illustrating the lip moving device.

FIG. 8 is a block diagram schematically illustrating the lip moving device. As shown in FIG. 8, the lip moving device includes a control part 300. The control part 300 controls the first to fourth motors 210, 220, 230, 240 and the cam motor 268 to perform the shape change of the lip member 100. Under the control of the control part 300, the first to fourth motors 210, 220, 230, 240 vary the torques to be applied to the ends of the first and second lip member and the cam motor 268 clockwise or counterclockwise rotates the cam body 271.

Figure 9:
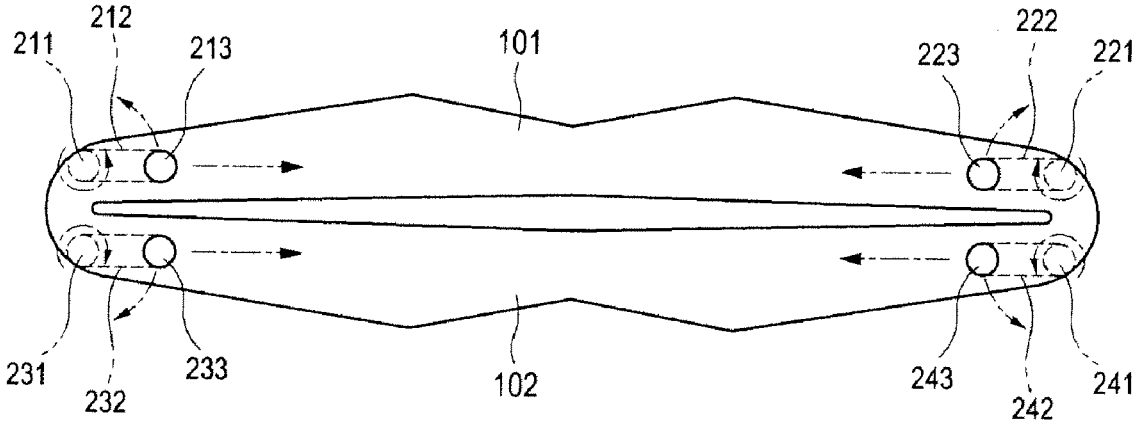
FIG. 9 schematically illustrates an example movement of lip members.
Figure 10:
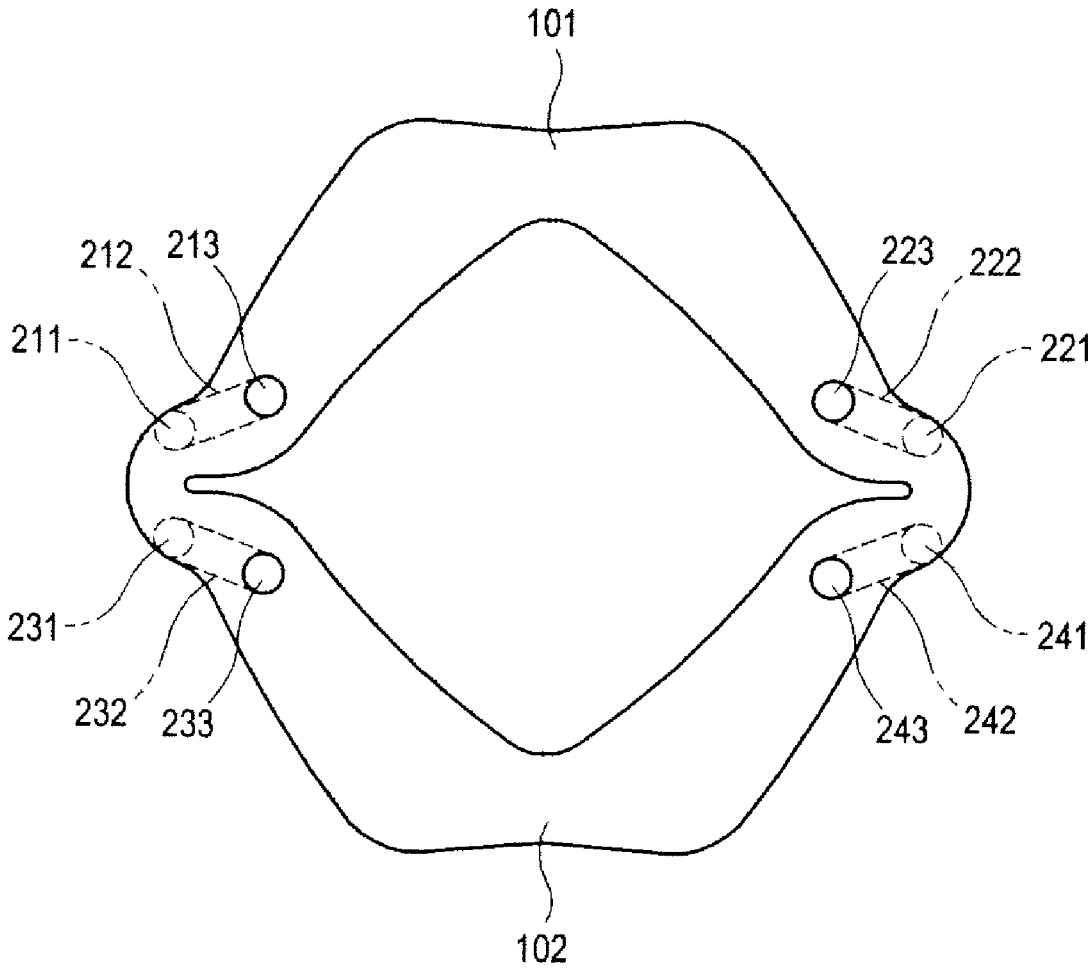
FIG. 10 schematically illustrates another example movement of the lip members.

FIGS. 9 and 10 schematically illustrate example movements of the lip member. When the first cam pin 266 is positioned at the second end 2732 of the first cam slot 273 and the second cam pin 267 is positioned at the second end 2742 of the second cam slot 274, the distance between the both ends of the lip member 100 may be longest as shown in FIG. 9. Unless the first to the fourth motors 210, 220, 230, 240 do not operate, the distance between the both ends of the lip member 100 may be maintained as shown in FIG. 9. In such a case, the lip member 100 is in a close state. When the first cam pin 266 is positioned at the first end 2731 of the first cam slot 273 and the second cam pin 267 is positioned at the first end 2741 of the second cam slot 274 after the rotation of the cam 270, the distance between the both ends of the lip member 100 may be shortest. In such a case, the distance between the both ends of the lip member is shortest. Thus, the lip member 100 forms a lip-shape suitable for pronouncing a vowel sound of [o].

A curvature or flexure of the first lip member 101 may be changed as the first motor 210 and the second motor 220 operate. Further, a curvature of flexure of the second lip member 102 may be changed as the third motor 230 and the fourth motor 240 operate. Thus, along with the operations of the first to fourth motors, the lip-shape of the lip member 100 may be changed to form another lip-shape for pronouncing another vowel sound. By way of an example, from the state shown in FIG. 9, the first coupling shaft 213 associated with the first motor 210 and the fourth coupling shaft 243 coupled to the fourth motor 240 may counterclockwise pivot and the second coupling shaft 223 associated with the second motor 220 and the third coupling shaft 233 associated with the third motor 230 may clockwise pivot. Then, a middle section of the first lip member 101 and a middle section of the second lip member 102 become distant from each other, and thus the lip member form a lip-shape suitable for pronouncing a vowel sound of [u], as shown in FIG. 10.

While another lip-shape for pronouncing another vowel sound is not described in detail herein, the lip member may form various lip-shapes suitable for pronouncing various single vowel sound in such a manner that the distance between the both ends of the lip member 100 are variously adjusted through action caused by the first and second frame, and that the operations of the first to fourth motors 210, 220, 230, 240 are variously controlled. Further, the lip member may form lip-shapes suitable for pronouncing diphthong sounds in such a manner that the curvature of flexure of the first and second lip members 101, 102 are sequentially changed by controlling the first to the fourth motors 210, 220, 230, 240 and the cam 270.

By way of an example, when the lip member 100 is rapidly sequentially changed from the state shown in FIG. 9 to the state shown in FIG. 10, the lip member 100 may form a lip-shape suitable for pronouncing a diphthong sound of [yu]. By way of another example, when the lip member 100 is rapidly sequentially changed from the state shown in FIG. 10 to the state shown in FIG. 9, the lip member 100 may form a lip-shape suitable for pronouncing a diphthong sound of [wi].

According to the embodiments described in the disclosure, the first and second lip members 101, 102 can be widened or narrowed simultaneously and curved in different directions together or alone. Accordingly, the lip moving device according to the embodiments may have more degrees of freedom in lip-shape change than a prior art robot lip moving device that cannot narrow the width of lips. Further, each of the coupling shafts 213, 223, 233, 243, which are coupled to the ends of the lip members, is apart from the corresponding motor shaft by the arm. Thus, bending force rather than torsional force can be applied to the first and second lip members 101, 102, thereby facilitate the change of the lip-shape and extending the deformation of the lip members. Accordingly, robots employing the lip moving device according to the embodiments described in the disclosure can perform lip-sync in harmony with voices of human and can show diverse emotional facial expressions Although embodiments have been described with reference to a number of illustrative embodiments thereof, it should be understood that various other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lip moving device for use in robots, comprising:

first and second lip members comprising a flexible material;

a first driving part applying a torque to one end of the first lip member;

a second driving part applying a torque to another end of the first lip member;

a third driving part applying a torque to one end of the second lip member;

a fourth driving part applying a torque to another end of the second lip member;

a frame member including:

a first frame mounting the first and third driving parts, a second frame mounting the second and fourth driving parts, and a supporting part, the first and second frames being pivotally coupled to the supporting part;

an adjusting part configured to pivot the first and second frames relative to the supporting part so as to adjust a distance between the first and third driving parts, adjust a distance between the second and fourth driving parts, and adjust a distance between both ends of the first and second lip members; and a control part configured to control the torques of the first, second, third and fourth driving parts and further configured to drive the adjusting part.

2. The lip moving device of claim 1, wherein the first driving part includes a first motor shaft, a first coupling shaft spaced-apart from the first motor shaft, and a first arm connecting the first motor shaft and the first coupling shaft, the first coupling shaft being coupled to the first lip member, wherein the second driving part includes a second motor shaft, a second coupling shaft spaced-apart from the second motor shaft and a second arm connecting the second motor shaft and the second coupling shaft, the second coupling shaft being coupled to the first lip member, wherein the third driving part includes a third motor shaft, a third coupling shaft spaced-apart from the third motor shaft and a third arm connecting the third motor shaft and the third coupling shaft, the third coupling shaft being coupled to the second lip member, and wherein the fourth driving part includes a fourth motor shaft, a fourth coupling shaft being apart from the fourth motor shaft and a fourth arm connecting the fourth motor shaft and the fourth coupling shaft, the fourth coupling shaft being coupled to the second lip.

3. The lip moving device of claim 2, wherein the first motor shaft is positioned at one end of the first lip member and the second motor shaft is positioned at the other end of the first lip member, wherein the first coupling shaft is coupled to one end of the first lip member and the second coupling shaft is coupled to the other end of the first lip member, wherein the third motor shaft is positioned at the one end of the second lip member and the fourth motor shaft is positioned at the other end of the second lip member, and wherein the third coupling shaft is coupled to the one end of the second lip member and the fourth coupling shaft is coupled to the other end of the second lip member.

4. The lip moving device of claim 1, wherein the adjusting part includes:

a cam motor mounted on the supporting part;

a cam rotatably coupled to the cam motor, the cam having a cam profile;

a first cam pin disposed on the first frame, the first cam pin contacting the cam profile so as to pivot the first frame relative to the supporting part when the cam rotates; and a second cam pin disposed on the second frame, the second cam pin contacting the cam profile so as to pivot the second frame relative to the supporting part when the cam rotates.

5. The lip moving device of claim 4, wherein the cam includes a cam body of a circular disc shape and a cam shaft configured to rotatably couple the cam body to the cam motor, wherein the cam profile defines first and second cam slots, the first and second cam slots being symmetrical to each other relative to the cam shaft, and wherein the first cam pin is inserted into the first cam slot, and the second cam pin is inserted into the second cam slot.

6. The lip moving device of claim 5, wherein the first and second cam slots have a circular arc shape, wherein the first and second cam slots are arranged such that a distance between one end of the first cam slot and one end of the second cam slot symmetrically corresponding thereto is shorter than a distance between an opposite end of the first cam slot and an opposite end of the second cam slot symmetrically corresponding thereto, and wherein the control part controls rotation of the cam body so as to adjust the distance between the first cam pin and the second cam pin.

7. The lip moving device of claim 1, wherein the one end and the another end of the first lip member are joined to the one end and the another end of the second lip member respectively.

* * * * *